US005881653A

United States Patent [19]

Pfister

[11] Patent Number: 5,881,653

[45] Date of Patent: Mar. 16, 1999

[54] SHELF ASSEMBLY SYSTEM

[76] Inventor: Joel W. Pfister, 4967 Kensington Gate, Shorewood, Minn. 55331

[21] Appl. No.: 869,566

[22] Filed: Jun. 5, 1997

[51] Int. Cl.[6] ..... A47B 9/00

[52] U.S. Cl. ..... 108/147.13; 108/192; 108/91; 211/188

[58] Field of Search ..... 108/91, 106, 192, 108/193, 147.13; 211/187, 188, 126.2, 133.1; 403/371, 369, 368, 367

[56] References Cited

U.S. PATENT DOCUMENTS

| | | | |
|---|---|---|---|
| 2,944,780 | 7/1960 | Monk . | |
| 3,424,111 | 1/1969 | Maslow . | |
| 3,874,511 | 4/1975 | Maslow . | |
| 4,138,953 | 2/1979 | Tashman | 108/147.13 |
| 4,444,125 | 4/1984 | Welsch et al. . | |
| 4,629,077 | 12/1986 | Niblock | 211/187 |
| 4,754,712 | 7/1988 | Olson et al. | 108/147.13 X |
| 4,763,799 | 8/1988 | Cohn et al. | 108/147.13 X |
| 4,799,818 | 1/1989 | Sudimak et al. | 108/147.13 X |
| 4,852,501 | 8/1989 | Olson et al. | 108/147.13 X |
| 5,127,342 | 7/1992 | Taylor | 108/147.13 |
| 5,154,558 | 10/1992 | McCallion | 403/371 X |
| 5,174,680 | 12/1992 | Nakamura et al. | 403/371 X |
| 5,423,251 | 6/1995 | Kolvites et al. | 108/147.13 X |
| 5,522,514 | 6/1996 | Robinson | 211/188 |
| 5,584,398 | 12/1996 | Lin | 211/188 X |
| 5,676,263 | 10/1997 | Chang | 211/188 X |
| 5,722,544 | 3/1998 | Williams | 108/107 X |

FOREIGN PATENT DOCUMENTS

| | | | |
|---|---|---|---|
| 2642844 | 4/1977 | Germany | 108/91 |

*Primary Examiner*—Peter M. Cuomo
*Assistant Examiner*—Hanh V. Tran
*Attorney, Agent, or Firm*—Hugh D. Jaeger

[57] ABSTRACT

Shelf assembly system for the rapid assembly of planar shelf boards having opposing interchangeable connector assemblies located at the ends of a leg where each connector assembly frictionally engages a bore in a planar shelf board. The interchangeable connector assemblies include tapered and split male and female connectors which mutually engage and compress inwardly toward each other and outwardly against the planar shelf board bore to secure the leg to each planar shelf board.

18 Claims, 18 Drawing Sheets

SHELF ASSEMBLY SYSTEM

CROSS REFERENCES TO CO-PENDING APPLICATIONS

None.

BACKGROUND OF THE INVENTION

1. Field of the Invention

The present invention is for shelving construction, and more particularly, pertains to a shelf assembly system for connection of one shelf to another shelf. A plurality of common and interchangeable components are incorporated to provide for rapid setup and assembly of shelving in a simple and straightforward manner not requiring the use of tools.

2. Description of the Prior Art

Prior art devices for assembly of shelving boards have been, in general, unsimplified in design and construction, often requiring the use of hand tools for assembly and erection. The use of annular grooves and rings and other configurations called for construction of geometrically configured and difficult to manufacture components for the attachment of legs to the shelving boards. Often these assembly methods proved somewhat expensive and required specialized and complicated machining for configuring the shelf board to accommodate leg attachment members and other assembly components.

The present invention provides a shelf assembly system which is simple to use, incorporates a minimum of components members, and which is readily utilized to construct shelf members with a minimum of effort.

SUMMARY OF THE INVENTION

The present invention is a shelf assembly system incorporated for the simple and rapid erection of shelving. A plurality of connector assemblies are provided to join the upper and lower ends of a shelf leg to a lower and one or more upper shelf boards. The connector assemblies are identical in construction and the assembly components are interchangeable and can be reoriented, thereby requiring a minimum of component members. The connector assemblies oppose each other at opposite ends of the leg and are oriented in opposing and mirror-like fashion. Each connector assembly includes a male and female connector which is split to allow for flexing during assembly to conform to variations in leg diameter or variations of a mounting hole or bore in the shelf board. The split male connector includes an inner surface of constant radius which terminates at an inwardly extending annular lip which accommodates one end of a leg which seats against the inwardly extending annular lip. The outer surface of the split male connector tapers inwardly as the exterior radius decreases from the upper leg entry end of the split male connector to the lower edge having the inwardly extending annular lip. The split female connector includes a constant radius exterior surface and includes an annular lip extending outwardly from the upper edge. The interior of the split female connector includes a tapered surface decreasing in radius from the upper outwardly extending annular lip to the lower annular edge or surface. The outer surface of the split female connector is accommodated by a bore in the shelving board and is inserted into the bore until the outwardly extending annular lip engages the planar surface of the shelf board. The split female connector is inserted into and accommodated by the shelving board bore to subsequently receive the split male connector into which one end of the leg has been previously inserted. The leg and the split male connector are forced into wedge-like engagement with the split female connector residing in the shelf board bore thereby forcing mutual expansion of the split female connector and compression of the split male connector, thus forcing the compressive capture of the leg by the split male connector and the expansive capture of the split female connector in the bore, and, more generally, effecting the overall securement of the leg to the shelf board.

According to one embodiment of the present invention, there is provided a shelf assembly system having a cylindrical or rod-shaped leg and similarly constructed opposing upper and lower connector assemblies which fit and frictionally engage the upper and lower ends of the cylindrical or rod-shaped leg. The connector assemblies include a split male and a split female connector which are generally in the form of modified cylindrical shapes. The split male connector includes a tapered outer circumference, a constant radius interior, an inwardly extending annular lip at the lower junction of the constant radius interior and the tapered outer circumference, and a slit or split area extending vertically through the wall of the split male connector and through the inwardly extending annular lip. The split female connector includes a constant radius circumferential exterior, a tapered interior surface, an outwardly extending annular lip at the upper junction of the constant radius circumferential exterior and the tapered interior surface, and a slit or split area extending vertically through the wall and the outwardly extending annular lip. The diameter of the interior surface of the split male connector corresponds to the outer diameter of the leg. The split male and female connectors mutually engage each other in frictional engagement to form a connector assembly and to secure the leg in a bore in a planar shelf board.

A first alternate embodiment illustrates the use of a connector assembly to connect an additional planar shelf board to previously erected shelving according to the teachings of the invention.

A second alternate embodiment illustrates a shelved caddy constructed according to the teachings of the invention.

A third alternate embodiment illustrates the support of wire shelving by various components of the invention.

A fourth alternate embodiment illustrates the support of a thick planar shelf board by various components of the invention.

One significant aspect and feature of the present invention is a shelf assembly system having a minimum of components which is readily assembled or disassembled without the use of hand tools.

Another significant aspect and feature of the present invention is a shelf assembly system having components which are easily and economically formed.

Another significant aspect and feature of the present invention is the use of split male and female connectors which mutually engage each other in wedge-like fashion to form a connector assembly which compresses about one or more ends of a tubular or rod-shaped leg member.

Another significant aspect and feature of the present invention is the use of split male and female connectors which mutually engage each other in wedge-like fashion to expand against a surrounding bore.

Another significant aspect and feature of the present invention is the use of split male and female connectors each of which includes a vertically aligned split for compression or expansion of the male or female connector, respectively.

Another significant aspect and feature of the present invention is a split male connector having an exterior tapered surface.

Another significant aspect and feature of the present invention is a split male connector having an inwardly extending annular lip against which one end of a leg seats.

Another significant aspect and feature of the present invention is a split female connector having an interior tapered surface.

Another significant aspect and feature of the present invention is a tubular or rod-shaped leg member.

Another significant aspect and feature of the present invention is the use of anodized aluminum legs to provide a controllable, constant and uniform leg diameter.

Another significant aspect and feature of the present invention is a split female connector having an outwardly extending annular lip which seats against the planar surface of a shelf board.

Another significant aspect and feature of the present invention is a planar shelf board having bores which accept and accommodate split male, split female connectors and other connector components.

Another significant aspect and feature of the present invention is the ability to vertically stack two or more shelving boards.

Another significant aspect and feature of the present invention is a double male connector having a stabilizing flange for use in stacking of planar shelf boards.

Another significant aspect and feature of the present invention is the use of a threaded stabilizer rod assembly in alignment with tubular legs, split male and female connectors, flanged double male connectors, planar shelf boards, and other components in a shelved caddy.

Another significant aspect and feature of the present invention is the ability to support wire shelving.

Another significant aspect and feature of the present invention is the ability to support thick planar shelf boards.

Having thus described significant aspects and features of several embodiments of the present invention, it is the principal object hereof to provide a shelf assembly system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
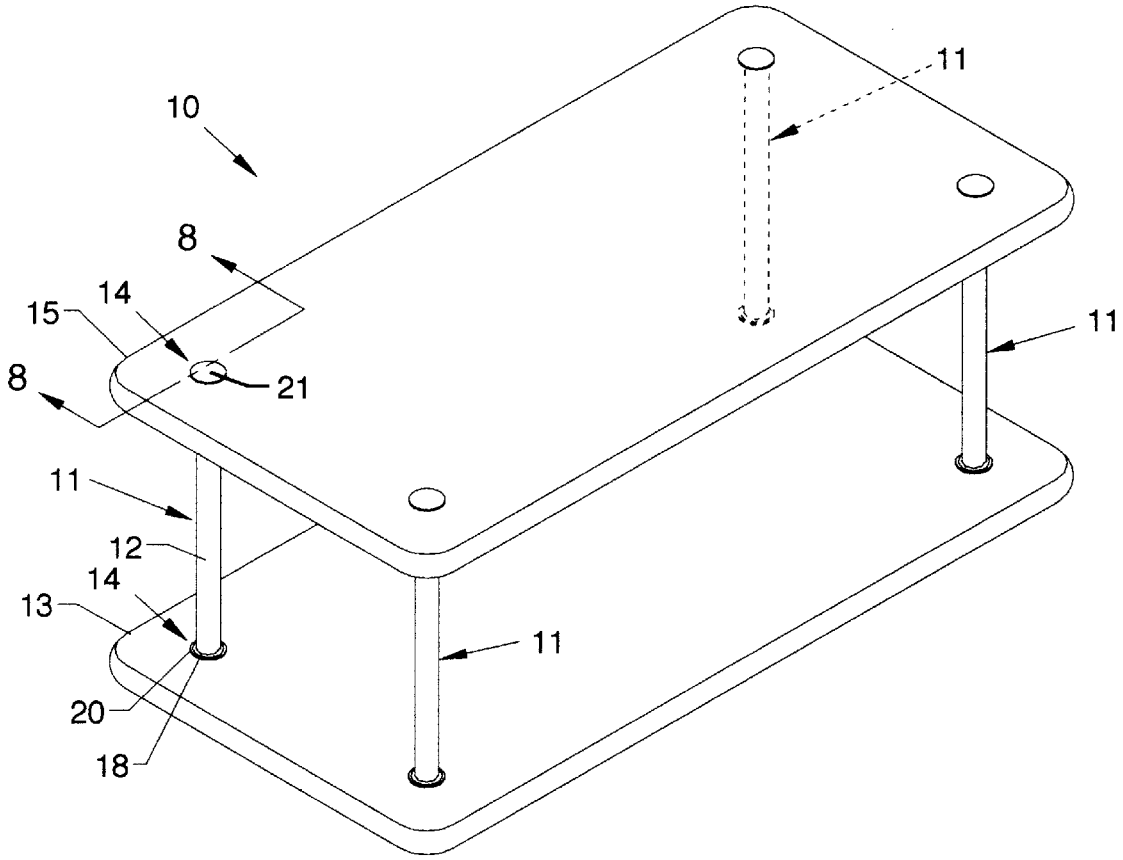
FIG. 1 illustrates an isometric view of a shelf assembly system, the present invention.

FIG. 1 illustrates an isometric view of a shelf assembly system 10, the present invention. The shelf assembly system 10 includes a lower planar shelf board 13 and an opposing and overlying planar shelf board 15 connected to each other by a plurality of like leg assemblies 11 extending vertically between the planar shelf boards 13 and 15.

Figure 2:
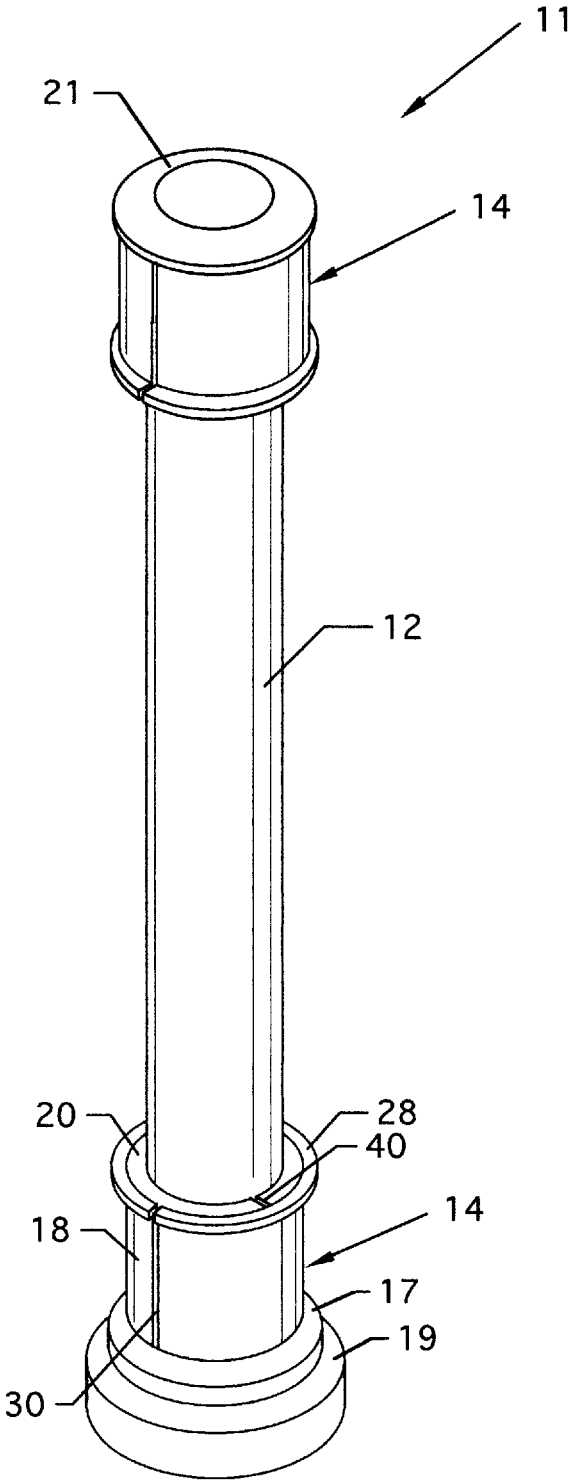
FIG. 2 illustrates an isometric view of a leg assembly.

FIG. 2 illustrates an isometric view of a leg assembly 11. The leg assembly 11 includes a centrally located cylindrical shaped leg 12 of anodized aluminum or other suitable material, a plurality of connector assemblies 14 including a connector assembly 14 aligned and frictionally engaged over and about the lower end of the leg 12, and, opposing the lower connector assembly 14 in mirror-like fashion, an upper connector assembly 14, which is interchangeable with the lower connector assembly 14, aligned and frictionally engaged over and about the upper end of the leg 12. Also included in the leg assembly 11 is a flanged tubular insert 17, a glide 19 at the lower end of the leg assembly 11 and a cap 21 at the upper end of the leg assembly 11. In the alternative, the leg 12 can be a solid rod, thereby not requiring a cap 21 and flanged tubular insert 17. Cylindrical legs throughout the invention are constructed of anodized aluminum to provide for uniform dimensional qualities, especially with regard to maintaining a suitable diameter from batch to batch. Other coatings, painting, or other treatment of the legs generally do not offer reliable dimensional control such as that offered by the use of anodized aluminum.

Figure 3:
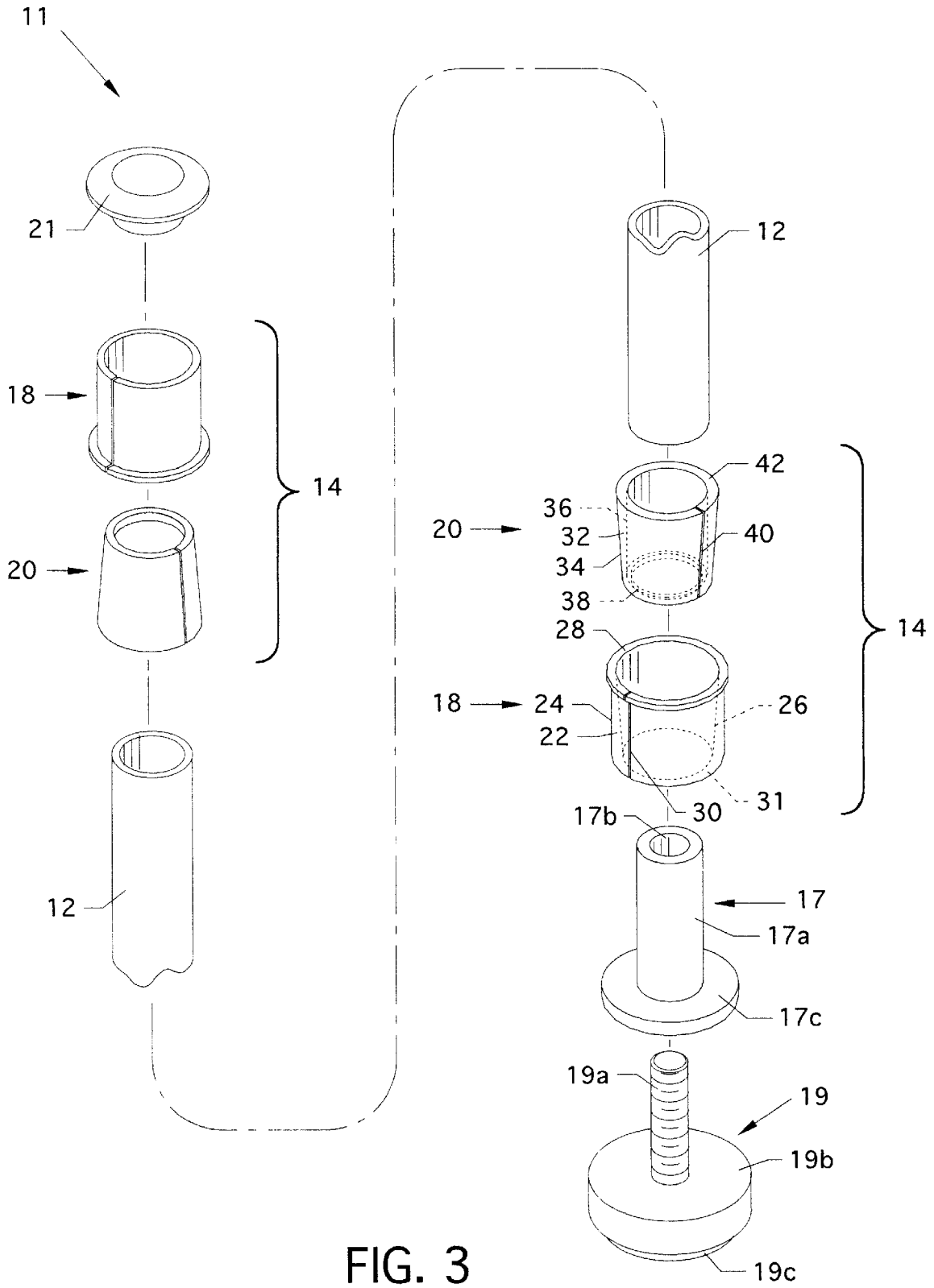
FIG. 3 illustrates an exploded view of the leg assembly.
Figure 4:
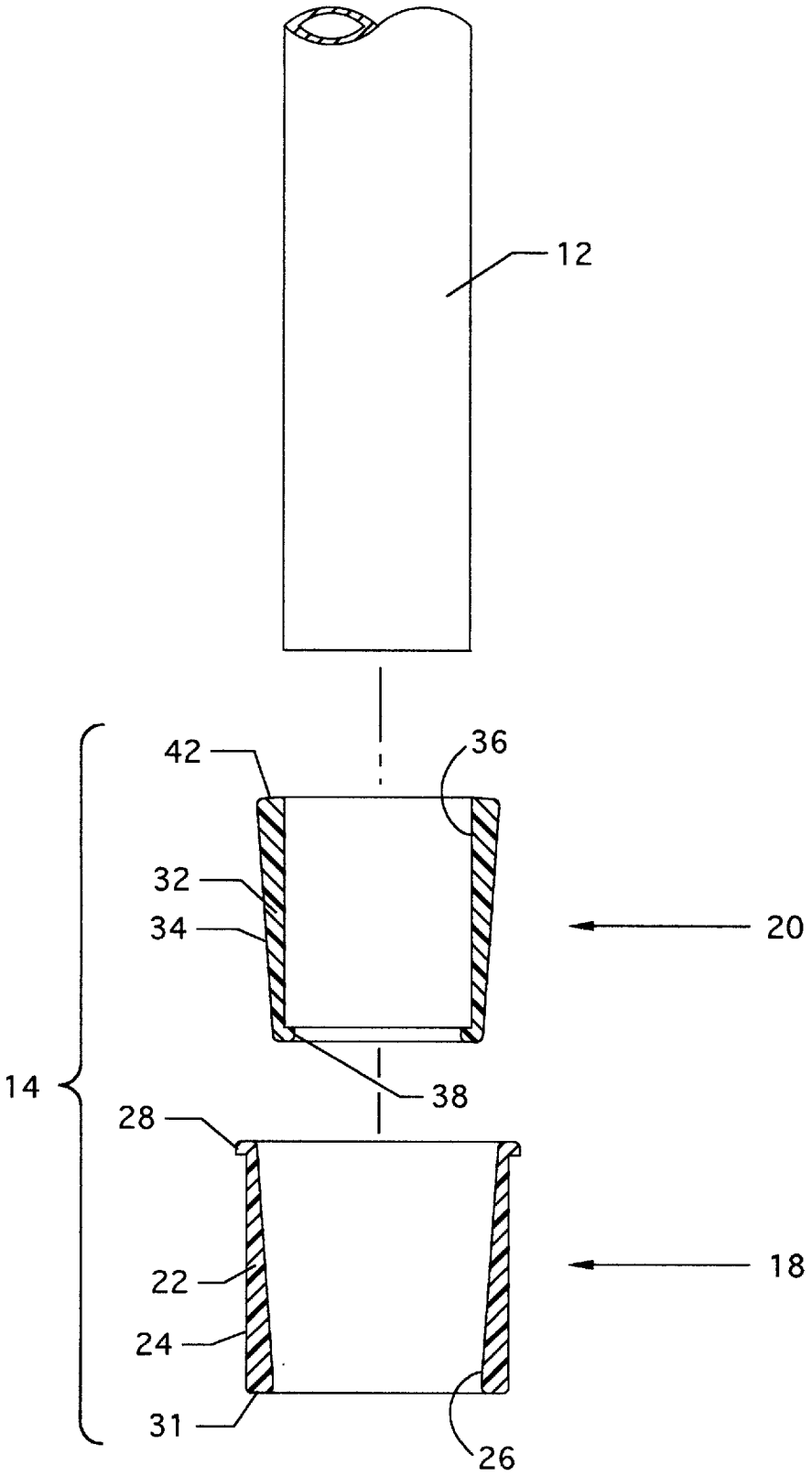
FIG. 4 illustrates an exploded cross sectional view of a leg, a split female connector, and a split male connector.

FIG. 3 illustrates an exploded view of the leg assembly 11, and FIG. 4 illustrates an exploded cross sectional view of the leg 12, a split female connector 18, and a split male connector 20, where all numerals correspond to those elements previously described. Upper connector assembly 14 and lower connector assembly 14 are constructed in a similar manner and fashion and are illustrated in opposing mirror-like fashion. With reference to FIGS. 3 and 4, the lower connector assembly 14 is now described. The lower connector assembly 14 includes a split female connector 18 and a split male connector 20, each connector including a wall having a constant radius surface, a tapered surface in the form of a truncated cone, a lip, and a slit interrupting the walls and lips. The slit female connector 18, being substantially cylindrical in shape, includes a wall 22 having an outer cylindrical surface 24 of constant radius, an opposing inner tapered surface 26, an annular lip 28 extending outwardly from the junction of the outer cylindrical surface 24 and the inner tapered surface 26 at the upper region of the wall 22, and a slit 30 interrupting the wall 22 and the annular lip 28. The radius of the taper of the inner tapered surface 26 decreases from the area adjacent to the annular lip 28 to the annular surface 31 at the lower region of the wall 22 opposing the annular lip 28. The slit male connector 20, being substantially cylindrical in shape, includes a wall 32 having an outer tapered surface 34, an opposing inner cylindrical surface 36 of constant radius, an annular lip 38 extending inwardly from the junction of the outer tapered surface 34 and the inner cylindrical surface 36 at the lower region of the wall 32, and a slit 40 interrupting the wall 32 and the annular lip 38. The radius of the taper of the outer tapered surface 34 increases from the area adjacent to the annular lip 38 to the annular surface 42 at the upper region of the wall 32 opposing the annular lip 38. The taper of the outer tapered surface 34 of the split male connector 20 corresponds to the taper of the inner tapered surface 26 of the split female connector 18. The flanged tubular insert 17 includes a cylindrical tube 17*a* with a bore 17*b*, and a flange 17*c* at one end. Glide 19 includes a shaft 19*a*, a disc 19*b*, and a plastic member 19*c* secured to the lower surface of the disc 19*b*.

Figure 5:
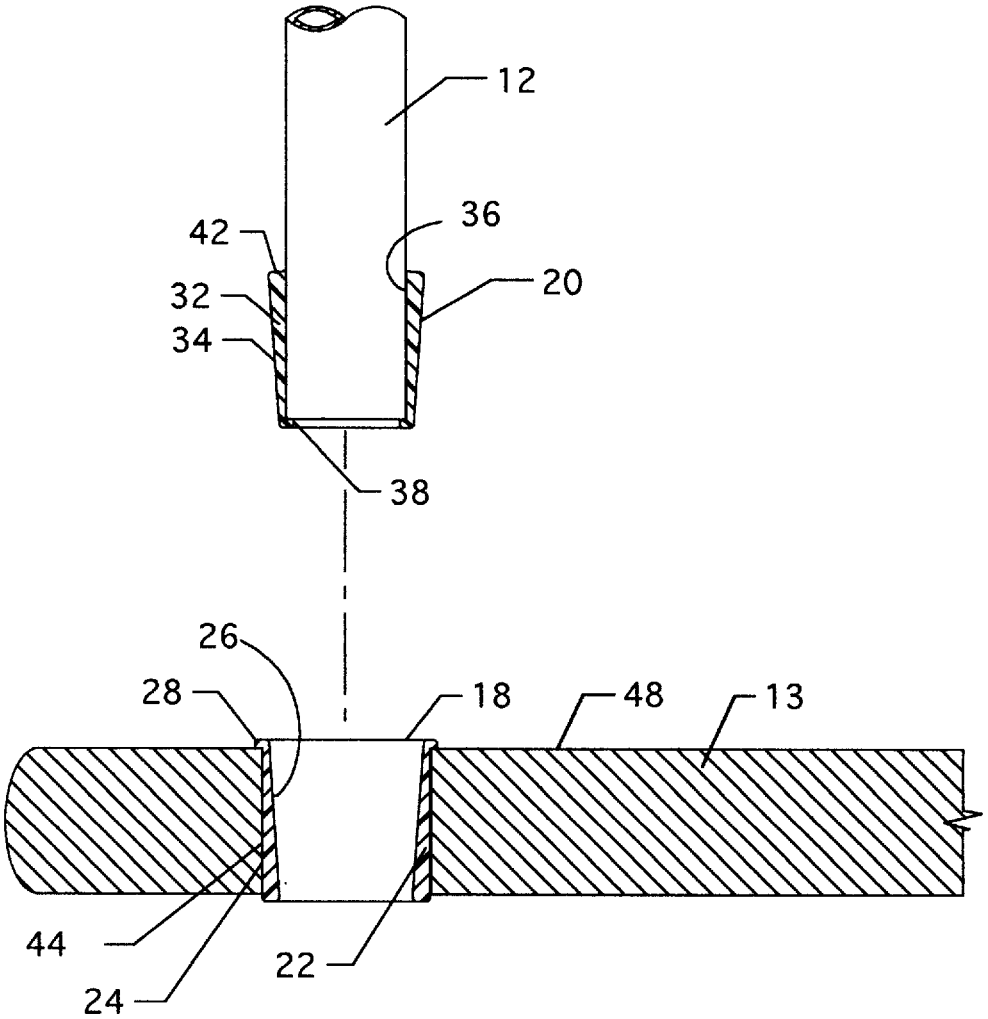
FIG. 5 illustrates a cross sectional view of a split male connector frictionally engaged over and about the lower end of a leg and a split female connector engaging a bore in a planar shelf board prior to mutual engagement.

FIG. 5 illustrates a cross sectional view of a split male connector 20 frictionally engaged over and about the lower end of a leg 12 and a split female connector 18 engaging a bore 44 in a planar shelf board 13 prior to mutual engagement, where all numerals correspond to those elements previously described. The inner cylindrical surface 36 of the split male connector 20 slidingly engages the lower end of the leg 12. The split male connector 20 is pushed over the end of the leg 12 until the inwardly extending annular lip 38 engages and seats against the end of the leg 12. The slit 40, illustrated in FIG. 3, allows for expansion or contraction of the split male connector 20 about its vertical axis to accommodate variance in the outer diameter of the leg 12 as well as various material shrinkages, expansions, or the like, of the leg 12, the split male connector 20 itself, or the split female connector 18 due to heat, cold, aging and other influences. The slit 40 also allows for inward compression of the wall 32 of the split male connector 20 against the engaged portion of the leg 12 when forceful engagement with the split female connector 18 is accomplished. The split female connector 18, which acts as a receptor for the split male connector 20 and leg 12, is inserted into a bore 44 in the planar shelf board 13 until the annular lip 28 engages and seats against the planar surface 48 of the planar shelf board 13. The slit 30, illustrated in FIG. 3, allows for expansion or contraction of the split female connector 18 about its vertical axis to accommodate variance in the diameter of the bore 44 as well as various material shrinkages, expansions, or the like, of the bore 44, the split female connector 18 itself, or the inserted split male connector 20 due to heat, cold, aging and other influences.

Figure 6:
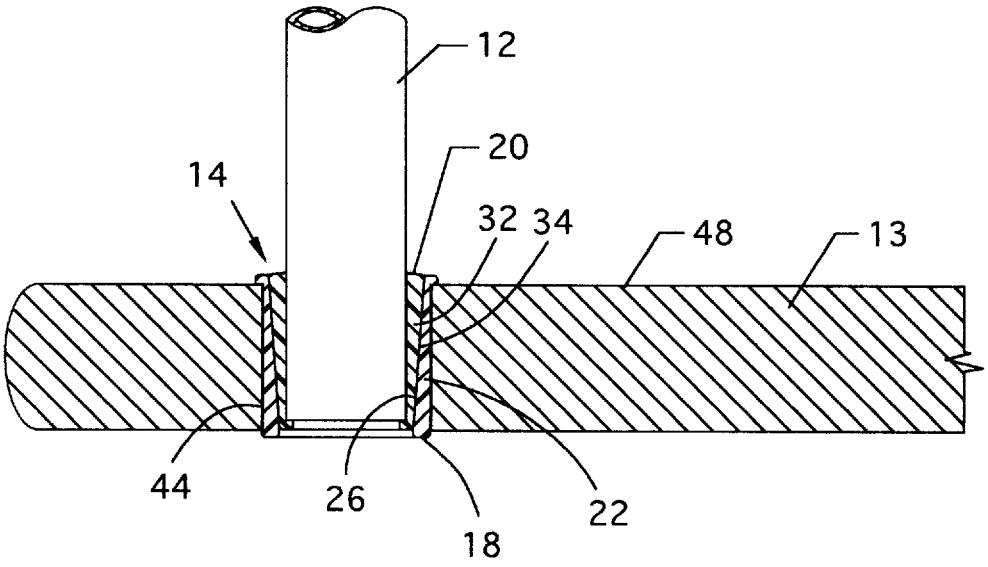
FIG. 6 illustrates a cross sectional view of a split male connector and the lower end of a leg in mutual engagement with a split female connector in a bore in a planar shelf board.

FIG. 6 illustrates a cross sectional view of a split male connector 20 and the lower end of a leg 12 in mutual engagement with a split female connector 18 in a bore 44 in a planar shelf board 13, where all numerals correspond to those elements previously described. During the forceful engagement process, the leg 12 forces the split male connector 20 into wedge-like compressional engagement with the split female connector 18. As the leg 12 and the split male connector 20 proceed into further engagement, split male connector 20 and the split female connector 18 mutually compress to provide for fixation of the leg 12, the split male connector 20, and the split female connector 18 in the bore 44 in the planar shelf board 13. This action provides for inward and outward mutual compression. As the split male connector 20 is forced in a downward direction, the wall 32 of the split male connector 20 is increasingly and inwardly compressed by reaction of the inner tapered surface 26 of the split female connector 18 against the outer tapered surface 34 of the wall 32 of the split male connector 20 to frictionally engage the leg 12. As the split male connector 20 is forced in a downward direction, the wall 22 of the split female connector 18 is increasingly and outwardly compressed by action of the outer tapered surface 34 of the split male connector 20 against the inner tapered surface 26 of the wall 22 of the split female connector 18 to frictionally engage the bore 44 in the planar shelf board 13. Respectively, inward and outward expansion of the split male connector 20 and of the split female connector 18 are accommodated and enhanced by the vertically oriented slits 40 and 30 in the walls 32 and 22 during compression.

Figure 7:
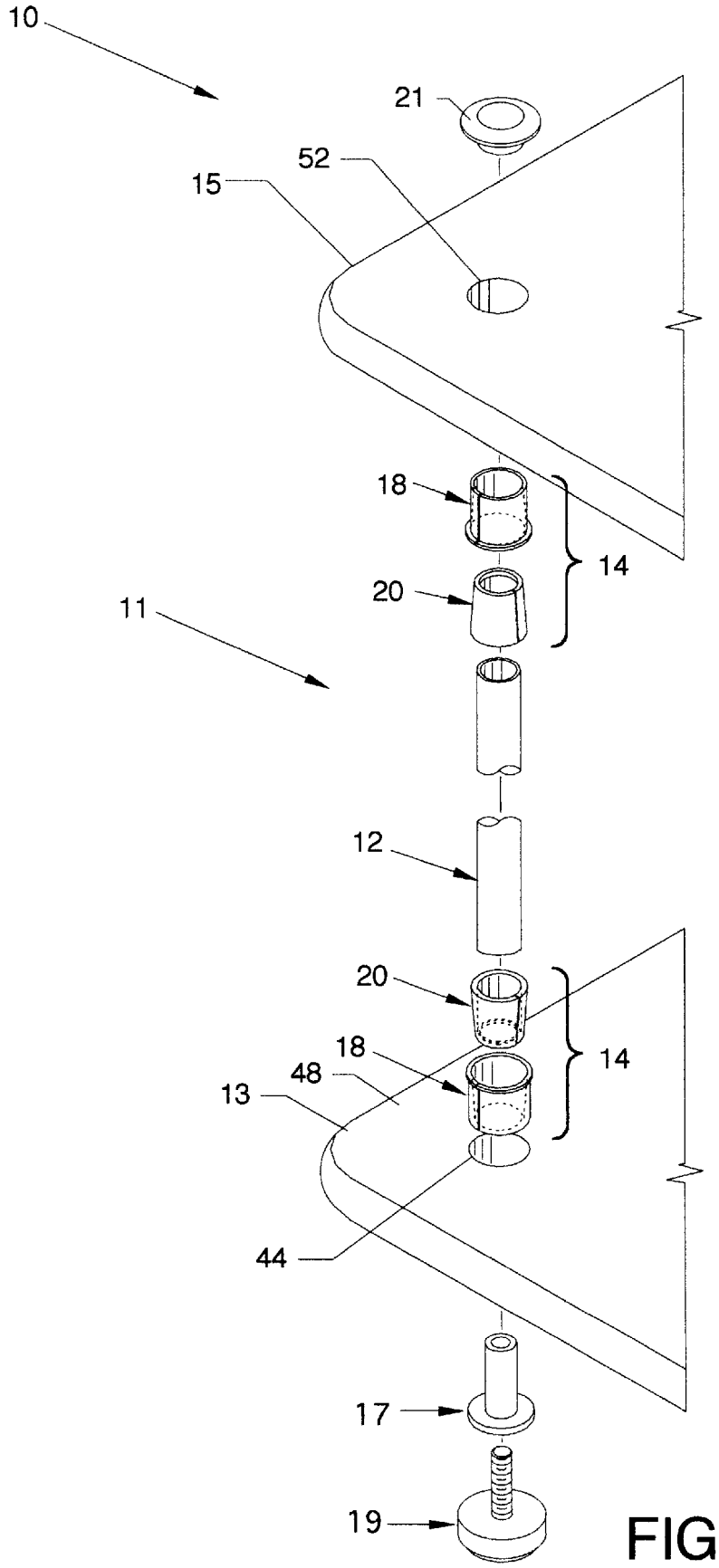
FIG. 7 illustrates an exploded view of a shelf assembly system.

FIG. 7 illustrates the use of the present invention to secure a planar shelf board 13 to a planar shelf board 15 aligned above the planar shelf board 13, where all numerals correspond to those elements previously described. A plurality of leg assemblies 11 extend vertically between the planar shelf board 13 located in the lower region of the shelf assembly system 10 and the planar shelf board 15 located in the upper region of the shelf assembly system 10 to form supported and elevated shelving. Although four leg assemblies 11 are illustrated in FIG. 1, additional leg assemblies 11 can be incorporated depending on the span of the planar shelf boards 13 and 15.

Figure 8:
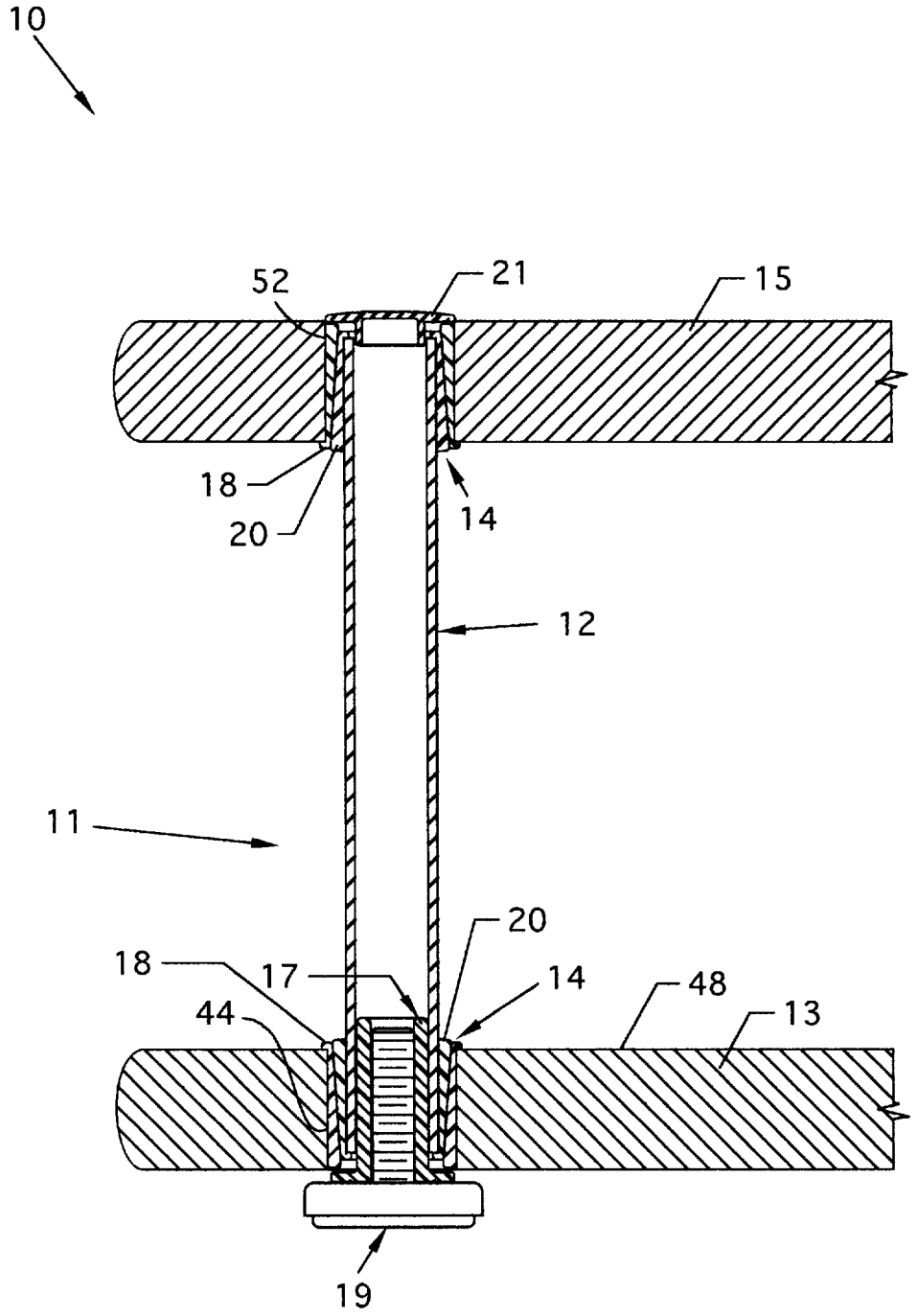
FIG. 8 illustrates a cross sectional view of a shelf assembly system along line 8—8 of FIG. 1.

FIG. 8 illustrates a cross sectional view of a shelf assembly system 10 along line 8—8 of FIG. 1. Leg assembly 11 aligns between bore 44 in the planar shelf board 13 and bore 52 in the planar shelf board 15, where all numerals correspond to those elements previously described.

Figure 9:
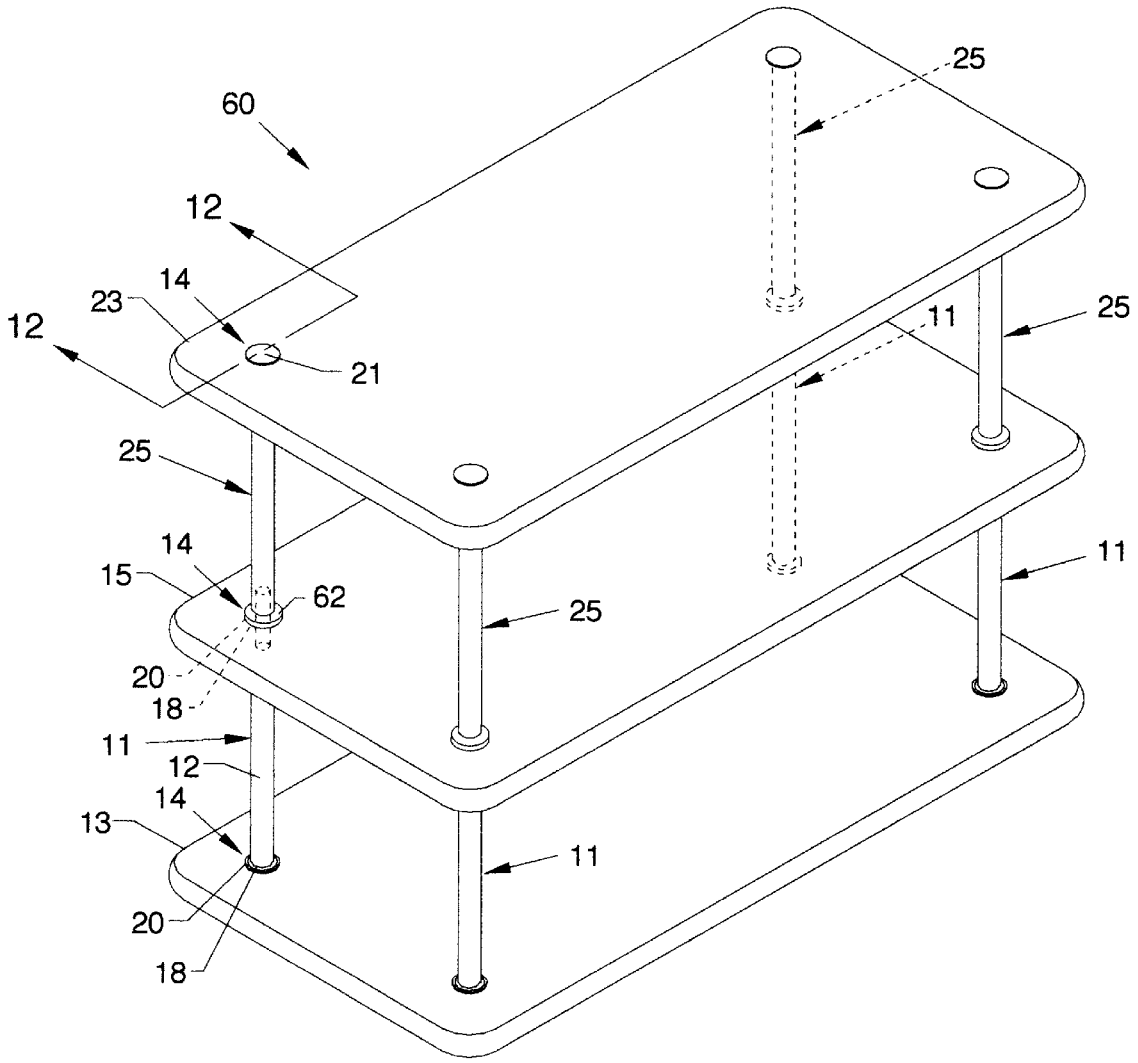
FIG. 9, a first alternate embodiment, illustrates an isometric view of a multilevel shelf assembly system connecting a lower planar shelf board to a mid-planar shelf board and the mid-planar shelf board to an upper planar shelf board.

FIG. 9, a first alternate embodiment, illustrates a shelf assembly system 60 incorporating the members of shelf assembly system 10 and additional members to provide for support of one or more additional planar shelf boards aligned over and above the planar shelf board 13, where all numerals correspond to those elements previously described. A plurality of like and similarly constructed leg assemblies 25 outwardly resembling and incorporating many of the components of leg assemblies 11 are incorporated to connect between the planar shelf board 15 and another planar shelf board 23 aligned above the planar shelf board 15. One-piece molded plastic flanged double male connectors 62, illustrated in FIG. 10, and being part of leg assemblies 25, are inserted into the tops of the leg assemblies 11, which terminate in the planar shelf board 15, to provide support for the leg assemblies 25. Conceivably, more leg assemblies 25 and planar shelf boards can be used to add additional levels of shelving.

Figure 10:
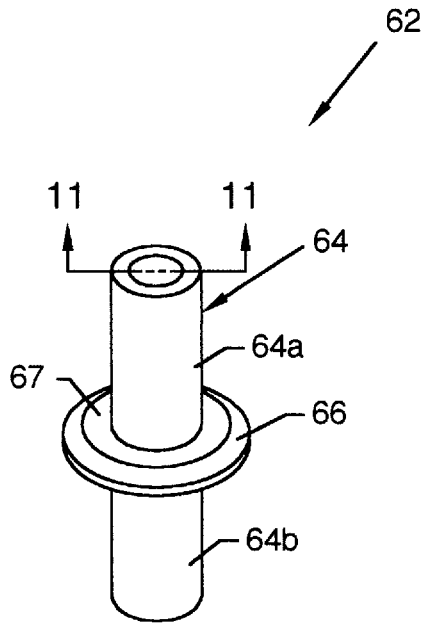
FIG. 10 illustrates an isometric view of a flanged double male connector.

FIG. 10 illustrates an isometric view of the flanged double male connector 62. The one-piece molded plastic flanged double male connector 62 includes a centrally located vertically aligned cylindrical member 64 and a flange 66 extending in annular fashion from the mid-section of the cylindrical member 64 essentially dividing the cylindrical member 64 into an upper cylindrical portion 64*a* and a lower cylindrical portion 64*b*. A planar surface 67 is located on the upper region of the flange 66 surrounding the cylindrical member 64. The flange is further illustrated in FIG. 11.

Figure 11:
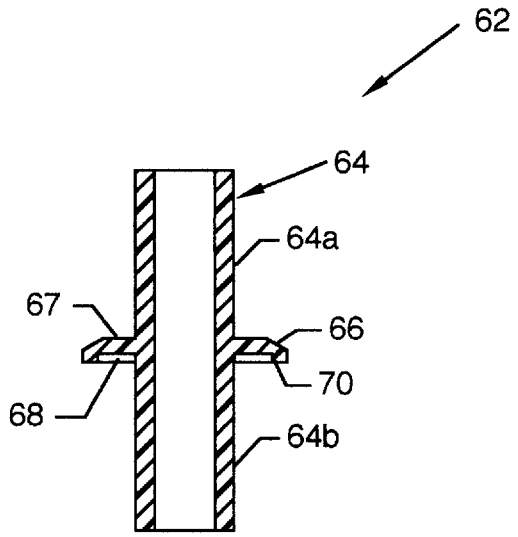
FIG. 11 illustrates a cross sectional view of the flanged double male connector along line 11—11 of FIG. 10.

FIG. 11 illustrates a cross sectional view of the flanged double male connector 62 along line 11—11 of FIG. 10, where all numerals correspond to those elements previously described. The flange 66 includes a recess 68 which accommodates, if necessary, any portion of the upper connector assembly 14 which may, but which does not necessarily, extend beyond the upper planar surface of a shelf board such as planar surface 69 of FIG. 12. Also included at the outer circumference of the flange 66 is an annular surface 70.

Figure 12:
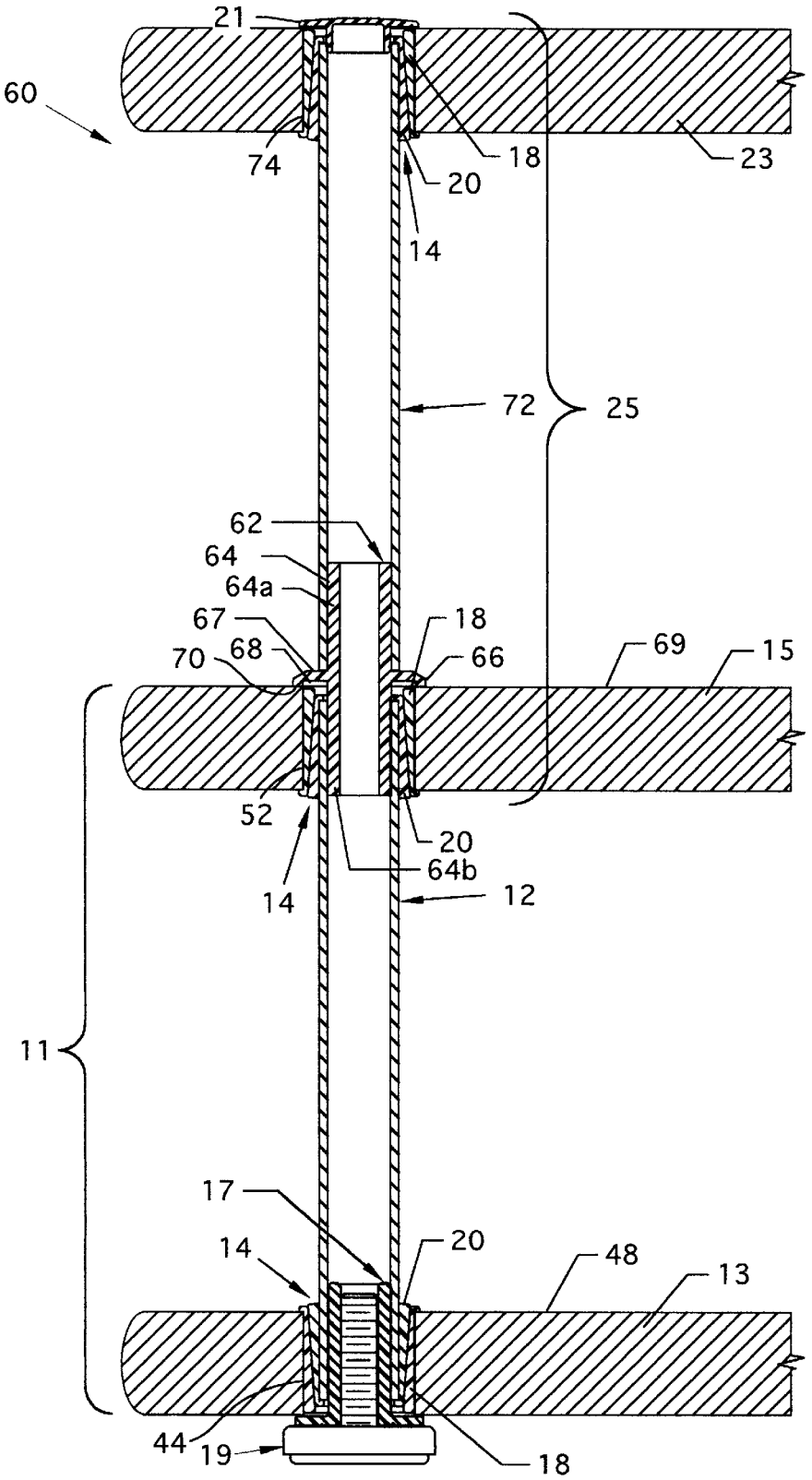
FIG. 12 illustrates a cross sectional view of the elements of FIG. 9 along line 12—12 of FIG. 9.

FIG. 12 illustrates a cross sectional view of the shelf assembly system 60 along line 12—12 of FIG. 9, where all numerals correspond to those elements previously described. Leg assembly 25 includes a flanged double male connector 62, a leg 72, an upper connector assembly 14 comprised of a split female connector 18 and a split male connector 20, and a cap 21. The outer diameters of upper and lower cylindrical portions 64*a* and 64*b* of the cylindrical member 64 form a close tolerance fit in frictional engagement with the inner diameters of upper leg 72 and lower leg 12, respectively. This close tolerance fit and the alignment of annular surface 70 of the flange 66 to the planar surface 69 on the planar shelf board 15 provides for stability of the flanged double male connector 62 and the entire leg assembly 25, as well as the planar shelf board 23. As previously noted, it can be seen that the annular recess 68 will allow for sizing differentials or extensions of the lower connector assembly 14 above the planar surface 69. The lower end of the leg 72, in frictional engagement with the upper cylindrical portion 64*a* of the cylindrical member 64, aligns to the planar surface 67 of the flange 66 for further stabilization of the leg 72. The upper end of the leg 72 connects to a bore 74 in the planar shelf board 23 by use of another upper connector assembly 14, as previously described.

Figure 13:
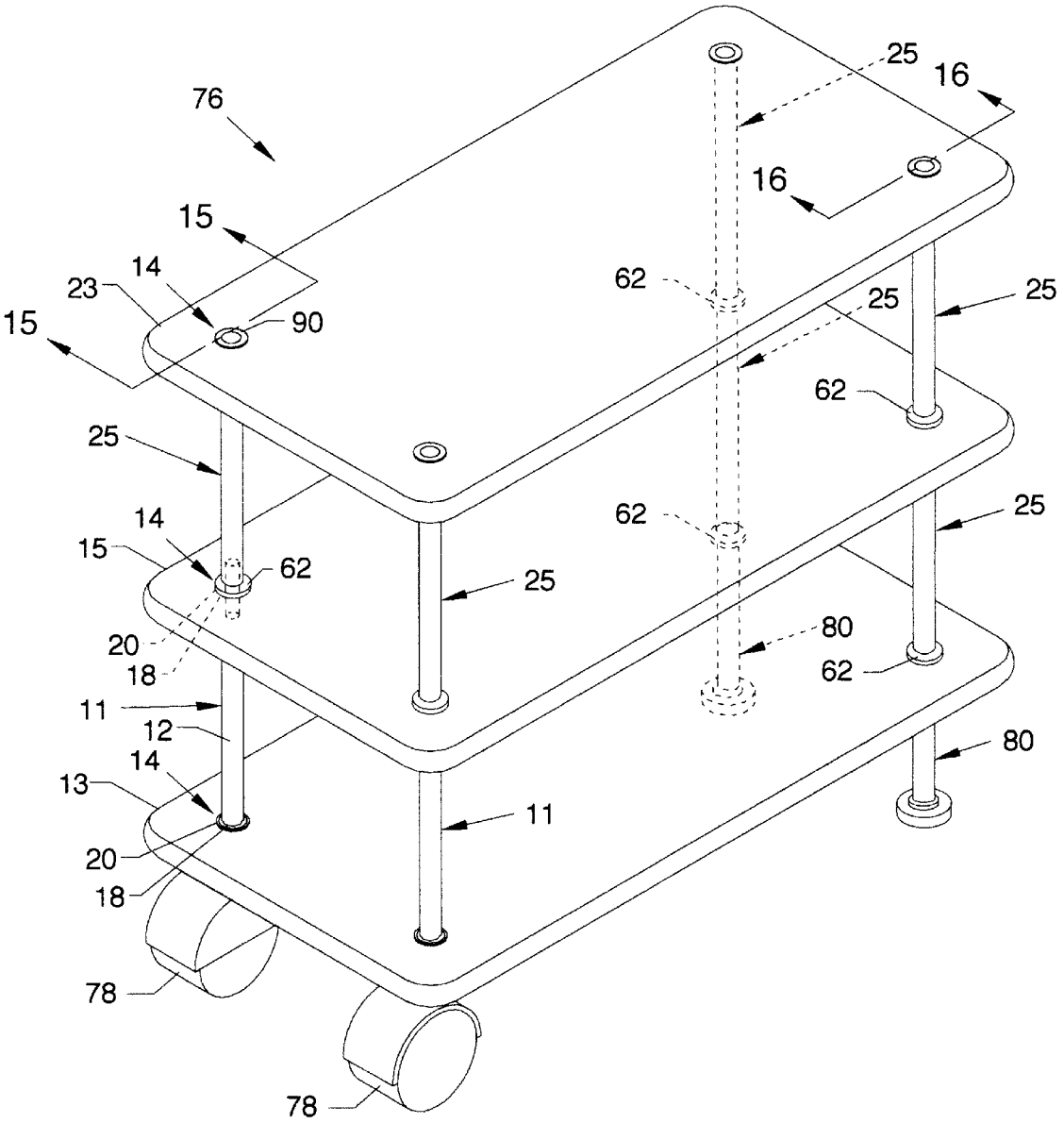
FIG. 13, a second alternate embodiment, illustrates a shelved caddy constructed according to the teachings and principles of the present invention.
Figure 14:
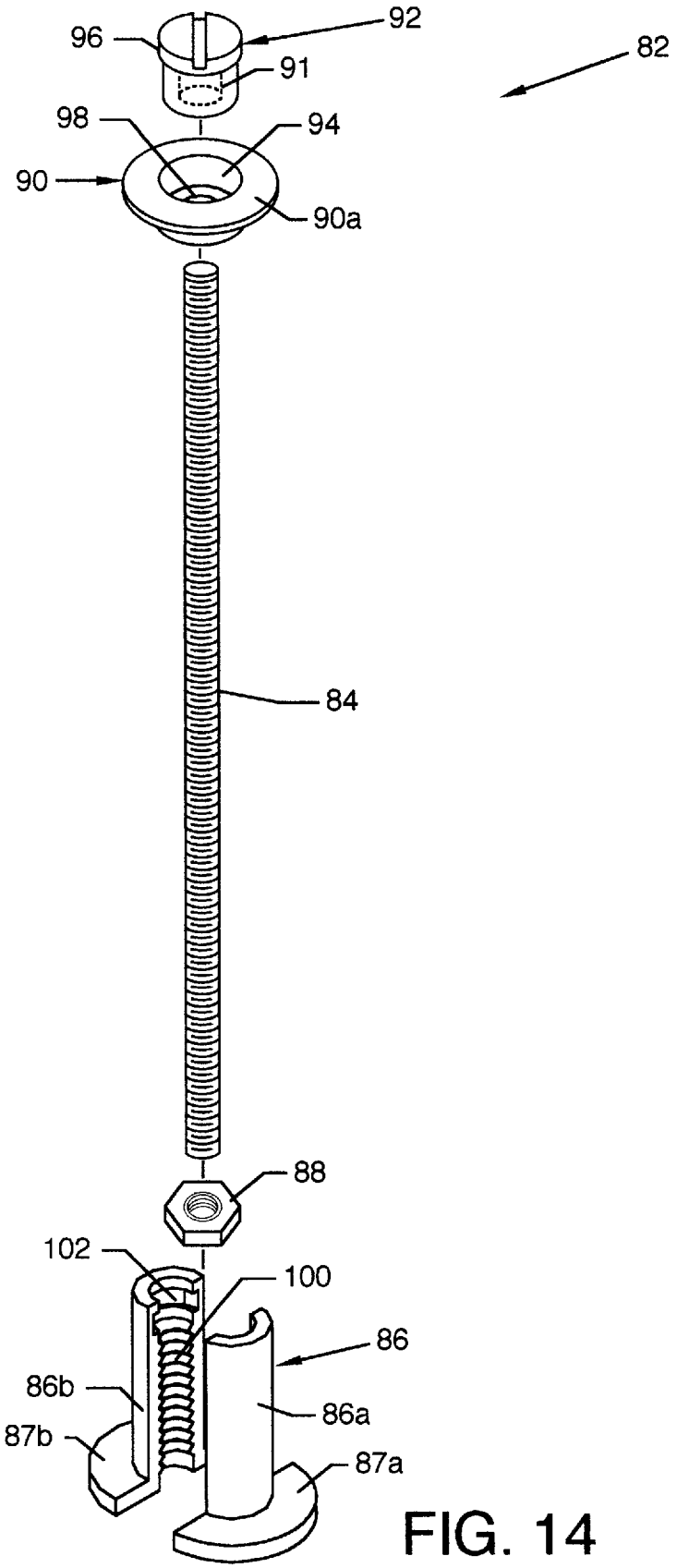
FIG. 14 illustrates an exploded isometric view of a threaded stabilizer rod assembly for use with the shelved caddy of FIG. 13.

FIG. 13, a second alternate embodiment, illustrates an isometric view of a shelved caddy 76 constructed according to the teachings and principles of the present invention, where all numerals correspond to those elements previously described. A plurality of previously described components including, but not limited to, leg assemblies 11 and 25 are incorporated to provide for multiple levels of planar shelf boards, as well as inclusion of wheels and glides. An internally located threaded stabilizer rod assembly 82 is incorporated for additional structural integrity, as illustrated in FIG. 14. Like casters 78 are inserted into the bottoms of the leg assemblies 11 at one end of the shelved caddy 76 where a pair of leg assemblies 11 connect planar shelf board 13 to planar shelf board 15, and another pair of leg assemblies 25 connects planar shelf board 15 to planar shelf board 23. The opposing end of the shelved caddy 76 incorporates a lower pair of leg assemblies 25 to connect planar shelf board 13 to planar shelf board 15 and an upper pair of leg assemblies 25 to connect planar shelf board 15 to planar shelf board 23. Additionally, like glide leg assemblies 80 connect to the lower ends of the lower leg assemblies 25 at the opposite end of the shelved caddy 76 incorporating the four leg assemblies 25.

Figure 15:
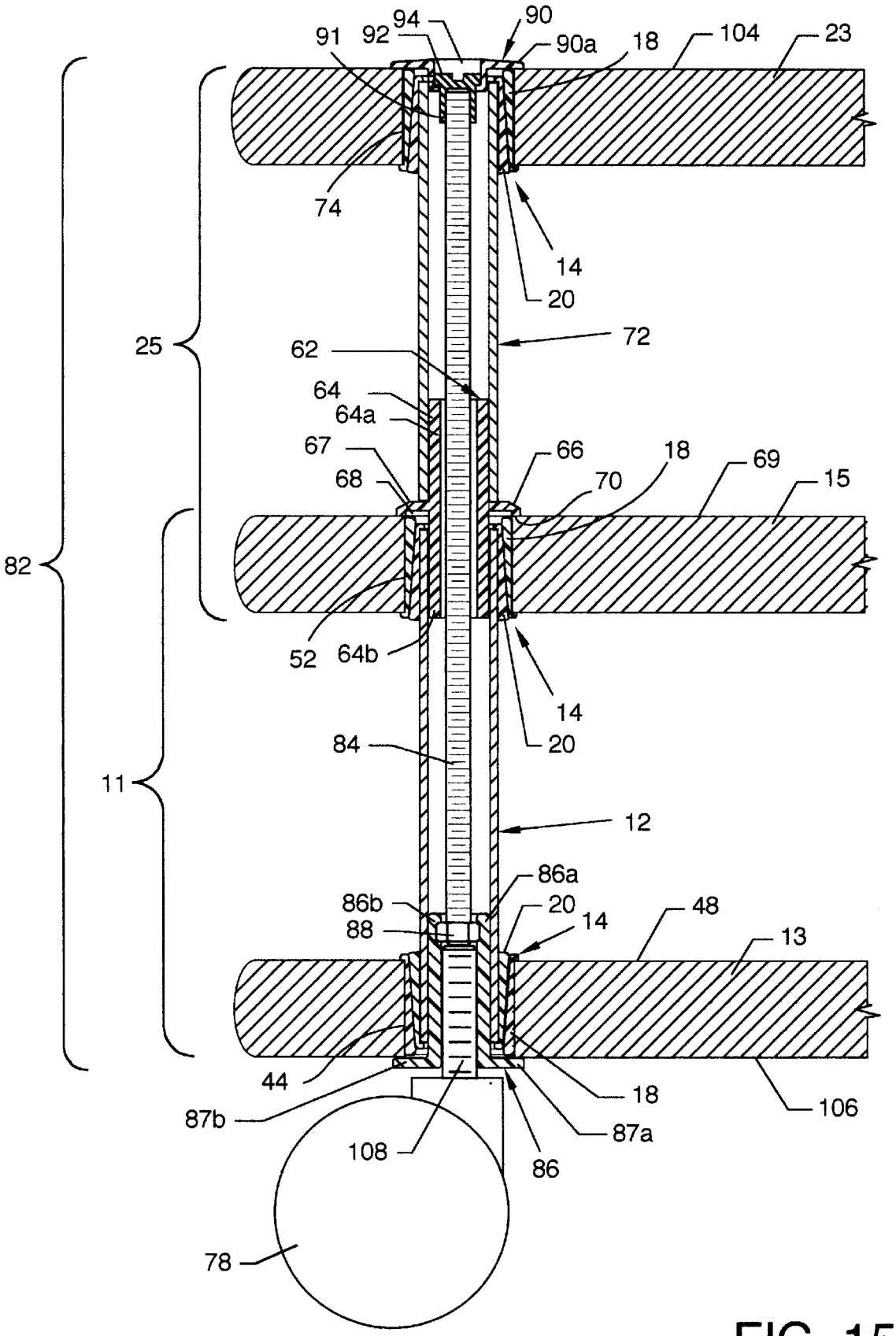
FIG. 15 illustrates a cross sectional view of the elements of FIG. 13 along line 15—15 of FIG. 13.

FIG. 14 illustrates an exploded isometric view of the threaded stabilizer rod assembly 82 including a centrally located threaded rod 84, a split flanged tubular insert 86, a nut 88, a recessed cap 90 including a disk portion 90*a*, and a slotted fixture 92. A recess 94 in the recessed cap 90 accommodates the shoulder 96 of the slotted fixture 92, a bore 98 accommodates the upper end of the threaded rod 84, and an internal bore 91 of the slotted fixture 92 fixedly engages and secures to the upper end of the threaded rod 84, as illustrated in FIG. 15. The split flanged tubular insert 86 includes halves 86*a* and 86*b*. Split flanged tubular insert half 86*b* reveals a threaded surface 100 and a molded interior capture surface 102 conforming to the shape of one-half of the nut 88. The split flanged tubular insert halves 86*a* and 86*b* include semicircular flanges 87*a* and 87*b*, respectively. The split flanged tubular insert half 86*a* includes like-configured surfaces, but they are not illustrated for the purpose of brevity and clarity.

FIG. 15 illustrates a cross sectional view vertically along line 15—15 of FIG. 13, where all numerals correspond to those elements previously described. Illustrated in particular is the assembled threaded stabilizer rod assembly 82 aligned coaxially through the leg assemblies 11 and 25. Slotted fixture 92 is rotated to rotate the threaded rod 84 in nut 88 to provide tension vertically along the threaded stabilizer rod assembly 82. This action provides for a constant vertically-applied force between the planar shelf boards 13, 15 and 23, as well as along the leg assemblies 11 and 25, thereby increasing engagemental force between the split male and female connectors 20 and 18 of the respective connector assemblies 14 by expanding the split male and female connectors 20 and 18 outwardly to further complement forcible contact of the split male and female connectors 18 and 20 with the respective planar shelf boards 13, 15 and 23. At the upper end of the threaded stabilizer rod assembly 82, the disk portion 90*a* of the recessed cap 90 overlaps the bore 74 of the planar shelf board 23 and forcibly bears upon the upper planar surface 104 on the planar shelf board 23. In a similar fashion, semicircular flanges 87*a* and 87*b* of the split flanged tubular insert 86 overlap the bore 44 of the planar shelf board 13 to forcibly bear upon the lower planar surface 106 of the planar shelf board 13. Also illustrated is a shaft 108, being part of the structure of the caster 78, inserted into the interior of the split flanged tubular insert 86 and in frictional engagement with interior threaded surface 100, best illustrated in FIG. 14.

Figure 16:
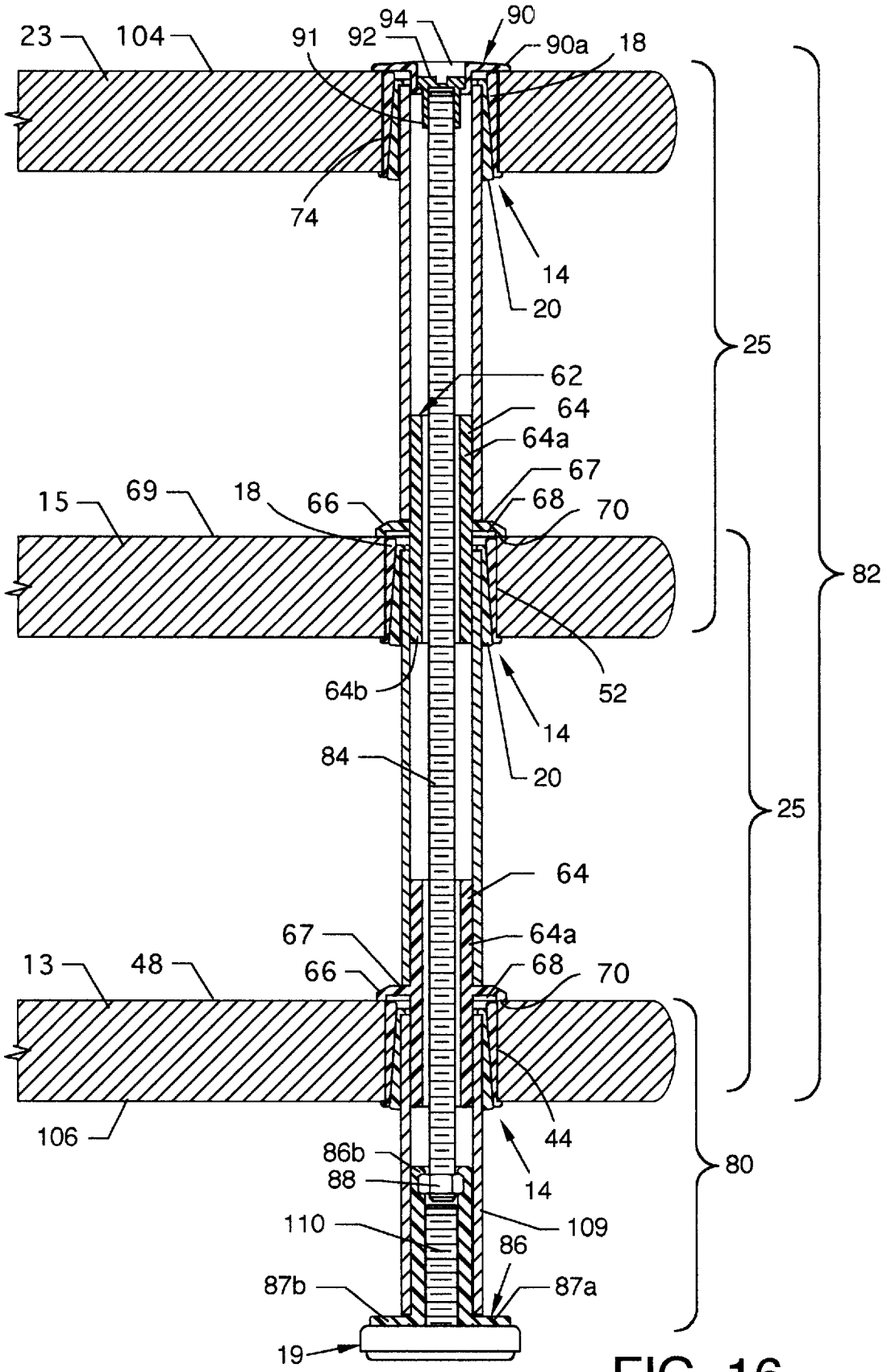
FIG. 16 illustrates a cross sectional view of the elements of FIG. 13 along line 16—16 of FIG. 13.

FIG. 16 illustrates a cross sectional view vertically along line 16—16 of FIG. 13, where all numerals correspond to those elements previously described. Illustrated in particular is the assembled threaded stabilizer rod assembly 82 aligned coaxially through the like vertically stacked leg assemblies 25 where one leg assembly 25 connects between planar shelf board 23 and planar shelf board 15, and another leg assembly 25 connects between planar shelf board 15 and planar shelf board 13. The threaded stabilizer rod assembly 82 also extends through and secures to a split flanged tubular insert 86 in the glide leg assembly 80. Slotted fixture 92 is rotated to rotate the threaded rod 84 in nut 88 to provide tension vertically along the threaded stabilizer rod assembly 82. This action provides for a constant vertically-applied force between the planar shelf boards 13, 15 and 23, as well as along the multiple leg assemblies 25 and the glide leg assembly 80, thereby increasing engagemental force between the split male and female connectors 20 and 18 of the respective connector assemblies 14 by expanding the split male and female connectors 20 and 18 outwardly to further complement forcible contact of the split male and female connectors 18 and 20 with the respective planar shelf boards 13, 15 and 23. The upper portion of tubular leg 109 engages the interior of connector assembly 14 located in bore 44 in planar shelf board 13. A split flanged tubular insert 86 is located in the lower interior portion of the tubular leg 109. Semicircular flanges 87*a* and 87*b*, being forced upward by the action of the threaded rod 84 and nut 88, bear upon the lower portion of the tubular leg 109 to distribute pressure across the planar shelf boards 13, 15 and 23. At the upper end of the threaded stabilizer rod assembly 82, the disk portion 90*a* of the recessed cap 90 overlaps a bore 74 of the planar shelf board 23 and forcibly bears upon the upper planar surface 104 on the planar shelf board 23. Also illustrated is a shaft 110, being part of the structure of the glide 19, inserted into the interior of the split flanged tubular insert 86 and in threaded engagement with interior threaded surface 100, best illustrated in FIG. 14.

Figure 17:
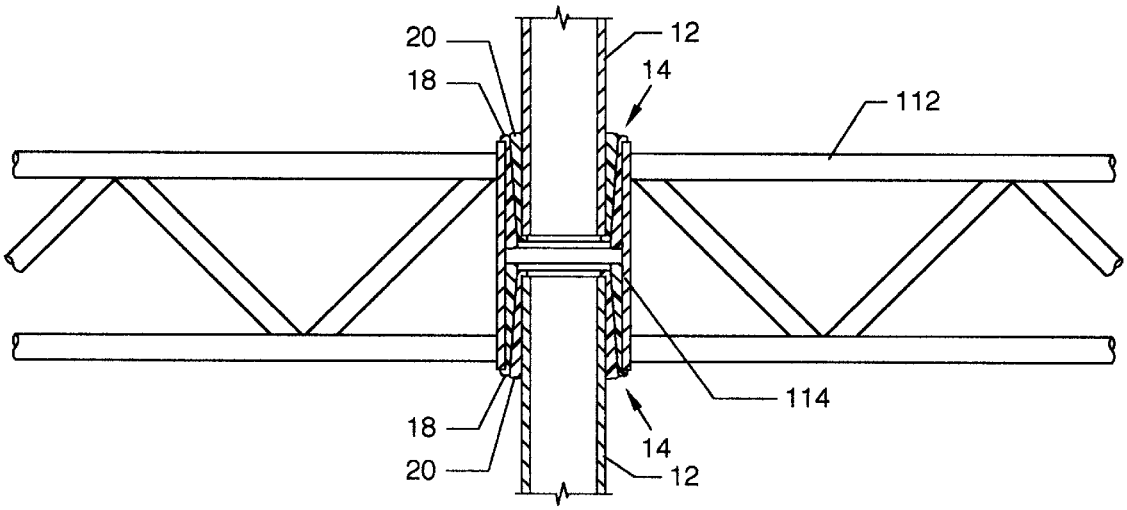
FIG. 17, a third alternate embodiment, illustrates the support of wire shelving by components of the invention; and, FIG. 18, a fourth alternate embodiment, illustrates the support of a thick planar shelf board by components of the invention.

FIG. 17, a third alternate embodiment, illustrates the support of wire shelving by previously described components of the invention and other such components, as now described, and where all numerals correspond to those elements previously described. Wire shelving 112 is suitably secured, such as by welding, to appropriate areas of a vertically aligned tube 114, preferably of anodized aluminum. A lower leg, such as leg 12, including a connector assembly 14 at its upper end, frictionally engages the lower region of the tube 114 according to the teachings and principles of the present invention. Another similarly fashioned leg 12 having a connector assembly 14 aligned over and about its lower end can be inserted into the upper region of the tube 114 for support of additional wire shelving or other shelving at a higher level, if desired.

Figure 18:
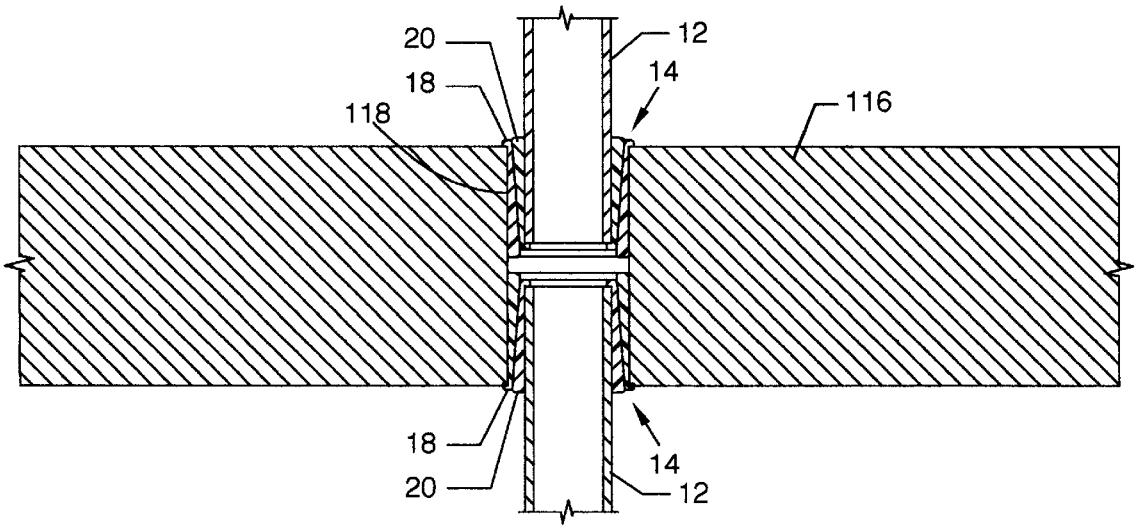

FIG. 18, a fourth alternate embodiment, illustrates the support of a thick planar shelf board 116 by a plurality of connector assemblies 14, where all numerals correspond to those elements previously described. Thick planar shelf board 116 includes a bore 118. A lower leg, such as leg 12, including a connector assembly 14 at its upper end, frictionally engages the lower region of the bore 118 according to the teachings and principles of the present invention. Another similarly fashioned leg 12, having a connector assembly 14 aligned over and about its lower end, can be inserted into the upper region of the bore 118 for support of additional shelving at a higher level, if desired.

Various modifications can be made to the present invention without departing from the apparent scope hereof.

I claim:

1. A leg assembly for a shelf assembly system, comprising:

a. an elongated leg of right circular cylindrical shape and having upper and lower ends;

b. a tubular male member having a smooth inner right circular cylindrical surface of a diameter substantially equal to the diameter of said leg and a smooth outer conical surface, thereby resulting in said tubular male member having a wall of a thickness which is greater at one end than at the other end, said tubular male member further having an inwardly directed annular lip at the end thereof of lesser wall thickness and a slit through said wall extending along its entire length including through said inwardly directed annular lip;

c. a tubular female member having a smooth inner conical surface and a smooth outer right circular cylindrical surface, thereby resulting in said tubular female member having a wall of a thickness which is greater at one end than at the other end, said tubular female member further having an outwardly directed annular lip at the end thereof of lesser wall thickness and a slit through said wall extending along its entire length including through said outwardly directed annular lip; and, d. said tubular male member being sized to fit within said tubular female member with said smooth conical outer wall of said tubular male member mating with said smooth conical inner wall of said tubular female member.

2. The leg assembly for a shelf assembly system as defined in claim 1, wherein said elongated leg is made of anodized aluminum.

3. The leg assembly for a shelf assembly system as defined in claim 1, wherein said elongated leg is solid in cross section.

4. The leg assembly for a shelf assembly system as defined in claim 1, wherein said elongated leg is tubular.

5. The leg assembly for a shelf assembly system as defined in claim 4, and further including a cap for closing said upper end of said elongated tubular leg.

6. The leg assembly for a shelf assembly system as defined in claim 4, and further including a right circular cylindrical tubular insert for insertion into said lower end of said elongated tubular leg to receive a shaft of a glide or caster, said tubular insert having an outer end with an outwardly directed annular flange.

7. The leg assembly for a shelf assembly system as defined in claim 6, and further including a glide, said glide having a shaft for insertion into said tubular insert, a flange on said shaft for abutment against said outwardly directed annular flange of said tubular insert, and a low friction plastic member carried by said flange on said shaft.

8. The leg assembly for a shelf assembly system as defined in claim 6, and further including a caster, said caster having a shaft for insertion into said tubular insert, and a wheel attached to said shaft.

9. The leg assembly for a shelf assembly system as defined in claim 4, and further including a double male connector for insertion into said upper end of said elongated tubular leg for connecting another elongated tubular leg to the first-mentioned elongated tubular leg, said double male connector being of right circular cylindrical shape and having an outwardly extending peripheral flange at substantially the mid-section thereof which divides said double male connector into an upper cylindrical portion and a lower cylindrical portion.

10. The leg assembly for a shelf assembly system as defined in claim 9, wherein said peripheral flange of said double male connector has upper and lower surfaces, said lower surface including an annular recess.

11. The leg assembly for a shelf assembly system as defined in claim 4, and further including a stabilizer rod assembly for placement within said elongated tubular leg, said stabilizer rod assembly comprising an externally threaded rod having an upper end and a lower end, a tubular insert composed of two identical mating halves each consisting of an internally threaded semicylindrical stem having an outwardly extending semicircular flange at one end thereof and an internal cavity at the other end thereof, a nut for threading onto said lower end of said externally threaded rod, a cap having a central recess at the bottom of which is a central opening for receiving said upper end of said externally threaded rod, and an internally threaded cap nut for threading onto said upper end of said externally threaded rod, said cap nut being dimensioned to fit within said central recess of said cap.

12. A shelf assembly system, comprising:

a. a plurality of planar shelf boards including a lower shelf board and one or more upper shelf boards;

b. a plurality of right circular cylindrical holes extending through each planar shelf board for receipt of like leg assemblies to join the plurality of planar shelf boards together in stacked relationship;

c. a plurality of like leg assemblies joining said plurality of planar shelf boards together;

d. each leg assembly comprising:

(1) an elongated leg of right circular cylindrical shape and having upper and lower ends;

(2) a first tubular male member having a smooth inner right circular cylindrical surface of a diameter slightly larger than the diameter of said leg and a smooth outer conical surface, thereby resulting in said first tubular male member having a wall with a thickness which is greater at one end than at the other end, said first tubular male member further having an inwardly directed annular lip at the end thereof of lesser wall thickness and a slit through said wall extending along the entire length of said wall including through said inwardly directed annular lip;

(3) a first tubular female member having a smooth inner conical surface and a smooth outer right circular cylindrical surface of a diameter slightly less than the diameter of a said hole in a said planar shelf board, thereby resulting in said first tubular female member having a wall with a thickness which is greater at one end than at the other end, said first tubular female member further having an outwardly directed annular lip at the end thereof of lesser wall thickness and a slit through said wall extending along the entire length of said wall including through said outwardly directed annular lip;

(4) said first tubular male member being sized to fit within said first tubular female member with said smooth conical outer wall of said first tubular male member mating with said smooth conical inner wall of said first tubular female member;

(5) a second tubular male member identical to said first tubular male member;

(6) a second tubular female member identical to said first tubular female member;

(7) said second tubular male member being sized to fit within said second tubular female member with said smooth conical outer wall of said second tubular male member mating with said smooth conical inner wall of said second tubular female member;

e. individual first female tubular members of said plurality of leg assemblies being positioned within respective said holes in said lower planar shelf board with said outwardly extending annular lips in engagement with the upper surface of said lower planar shelf board;

f. individual second female tubular members of said plurality of leg assemblies being positioned within respective said holes in an upper planar shelf board with said outwardly extending annular lips in engagement with the undersurface of such upper planar shelf board;

g. individual elongated legs of said plurality of leg assemblies each having a said first tubular male member disposed over and about its lower end and a said second tubular male member disposed over and about its upper end with the inwardly extending annular lips of said first and second tubular male members in engagement with the end surfaces of the respective elongated legs; and, h. each said first and second tubular male member smooth conical outer surface being wedged into engagement with a respective said first and second tubular female member smooth conical inner surface, thereby creating a stable shelf assembly system with said lower and upper planar shelf boards joined in stacked relationship.

13. A shelf assembly system comprising:

a. a lower shelf board and an upper shelf board;

b. each shelf board having a plurality of right circular cylindrical leg receiving holes extending through the thickness thereof;

c. each said hole being lined with a tubular female member having a cylindrical outer surface matching the cylindrical shape of the hole and having a conical inner surface;

d. a plurality of elongated legs corresponding in number to the number of leg receiving holes in an individual shelf board, each elongated leg having an upper end and a lower end;

e. individual tubular male members received over said upper and lower ends of each elongated leg, each tubular male member having a cylindrical inner surface and a conical outer surface; and, f. each tubular male member at the upper end of each elongated leg being wedged into a respective tubular female member in said upper shelf board, and each tubular male member at the lower end of each elongated leg being wedged into a respective tubular female member in said lower shelf board.

14. The shelf assembly system as defined in claim 13, wherein both said lower shelf board and said upper shelf board are planar and of substantially rectangular shape, and wherein said plurality of leg receiving holes in each shelf board are four in number and are positioned at each of the four corners thereof inwardly of the perimeter thereof.

15. The shelf assembly system as defined in claim 13, wherein each of said elongated legs is tubular and of right circular cylindrical shape.

16. The shelf assembly system as defined in claim 13, wherein each said tubular female member lining the holes in said upper shelf board has an outwardly directed lip abutting the undersurface of said upper shelf board, and wherein each said tubular female member lining the holes in said lower shelf board has an outwardly directed lip abutting the top surface of said lower shelf board.

17. The shelf assembly system as defined in claim 13, wherein each said tubular male member received over said upper and lower ends of each elongated leg has an inwardly directed lip bearing against the associated end of each elongated leg.

18. The shelf assembly system as defined in claim 13, wherein each said tubular female member and each said tubular male member has a slit extending through the wall thereof along its entire length.

* * * * *